United States Patent [19]

Yeh

[11] Patent Number: 4,729,747

[45] Date of Patent: Mar. 8, 1988

[54] HEAD-MOUNTED DOUBLE MOTOR-DRIVEN TOY

[76] Inventor: John Yeh, 6th Fl., No. 210 An-Ho Rd., Taipei, Taiwan

[21] Appl. No.: 888,981

[22] Filed: Jul. 24, 1986

[51] Int. Cl.[4] ..... A63H 33/00

[52] U.S. Cl. ..... 446/27; 446/484

[58] Field of Search ..... 446/27, 484; 2/171.3

[56] References Cited

U.S. PATENT DOCUMENTS 3,491,374 1/1970 Frangos ..... 2/171.3

4,488,372 12/1984 Lowen ..... 446/27

*Primary Examiner*—Philip C. Kannan

*Attorney, Agent, or Firm*—Cushman, Darby & Cushman

[57] ABSTRACT

The present invention discloses a head-mounted double motor-driven toy comprising a head-mounting ring having a central portion and two free end portions extending from the central portion; a battery case integrally formed on the top of the central portion of the head-mounting ring for accommodating batteries and a control switch; and two motor seats equiped with motors, which are secured to the free end portions of the head-mounting ring, each motor has a rotation shaft extending through the motor seat perpendicularly to the central portion; a joint secured to the rotation shaft of the motor for being rotated with the rotation shaft; a plurality of ornaments secured to the joint; the motors are ceonnected to the batteries through the control switch for selectively supplying electrical power to the motors to drive the rotation shafts.

1 Claim, 3 Drawing Figures

HEAD-MOUNTED DOUBLE MOTOR-DRIVEN TOY

BACKGROUND OF THE INVENTION

The present invention relates to a head-mounted double motor-driven toy with two rotating attractive articles which may be preferably but not necessarily mounted on top of a child's head.

In prior art, one headgear, as disclosed in the U.S. Pat. No. 3,491,374, Everett W. Frangos, comprises a helmet, a hoop pivotally mounted on either side of the helmet, and a propeller mounted on the hoop which can rotate and oscillate automatically back and forth over the top of the head of the wearer by a separate drive mechanism. Another attention-attracting unit comprises a head-mountable clasp which carries a light-weight D.C. motor with a small lightweight battery alongside it as disclosed in the U.S. Pat. No. 4,488,372, Stephen Lowen. The motor has a shaft which is vertical when the clasp is on the wearer's head, and has connected to it a rod on the opposite ends of which large light-weight ornaments are attached, so that the rod, together with the ornaments, turns about the center of the shaft. However, since the motor and battery are on the top of wearer's head, the center of mass is too high, and the clasp easily becomes loose on the wearer's head when the rotating parts are activated by the motor. To solve this problem, the clasp must be made tight. This usually causes the wearer discomfort.

SUMMARY OF THE INVENTION

The primary object of the present invention is to provide a head-mounted double motor-driven toy which utilizes two motor-driven units provided on two free ends of a head-mounted band to balance the toy and lower the center of mass, this way it can be worn on one person's head stably and firmly.

Another object of the present invention is to provide a toy which needs a smaller clamping force than the prior unit to be kept on the wearer's head without becoming loose, and can be operated readily and comfortably.

According to the present invention, a head-mounted double motor-driven toy comprises of: a head-mounting band having a central portion and two free end portions extending from the central portion; a battery case integrally formed on the top of the central portion of the head-mounting band for accommodating batteries and a control switch; and two motor seats equiped with motors which are secured to the free end portion of the head-mounting band, each motor has a rotation shaft extending through the motor seat perpendicularly to the central portion; a joint secured to the rotation shaft of the motor for being rotated with the rotation shaft; a plurality of ornaments secured to the joint; the motors are connected to the batteries through the control switch which can selectively supply them with electrical power.

BRIEF DESCRIPTION OF THE DRAWINGS

The present invention will be more fully understood from the following detailed description, taken in connection with the accompanying drawings which form an integral part of this application and in which.

DETAILED DESCRIPTION OF THE PREFERRED EMBODIMENTS

Figure 1:
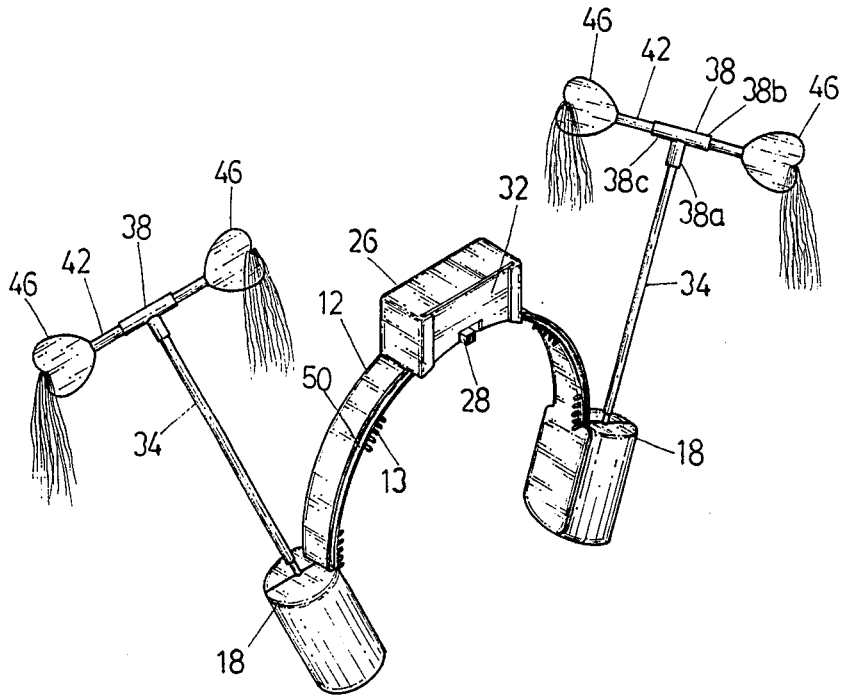
FIG. 1 is a view in perspective of a head-mounted double motor-driven toy in accordance with one preferred embodiment of the present invention.
Figure 2:
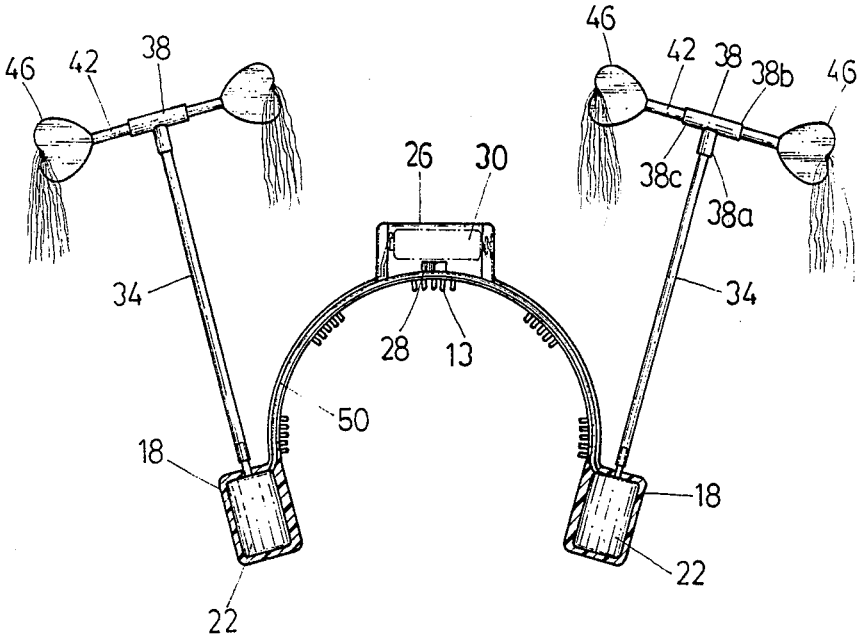
FIG. 2 is a front elevational view of the head-mounted double motor-driven toy of FIG. 1, with portions thereof cut away for illustration of the motors fixed in the motor seats.

Referring now to the drawings, it should be noted that a like component is designated with a like reference number. In FIGS. 1 and 2, a head-mounted double motor-driven toy includes a head-mounting band 12 with paralled ribs 13 along its inner side. The object of the ribs is to secure the band more firmly on the head of the wearer. A battery case 26 is integrally formed on the top portion of the band 12, one (or more than one) battery 30 is received within the battery case 26 whereas a cover plate 32 is inserted in it's front end. Two motor seats 18 are secured to two free ends of the head-mounting band 12 respectively within which two motors 22 are accommodated, and the motor's rotation shaft 34 extend upward through each motor seat 18.

Two T-shaped joints 38 are firmly fastened on the two rotation shafts 34 at their fitting elements **38*a* which inner diameter is substantially equal to the outer diameter of the rotation shaft 34. The other fitting elements 38*b*, 38*c* of the T-shaped joints 38 are firmly inserted in free rods 42; two heart-shaped ornaments 46 are fixed at free ends of the free rods 42**.

A switch 28 is also accommodated within lower portion of the battery case 26, which connects between the motors 18 and the battery 30 through the wires 50 so as to manually switch on/off the motors 30. The head mounting band 12 is preferably hollow, so that the wires 50 can be deposed within it.

Figure 3:
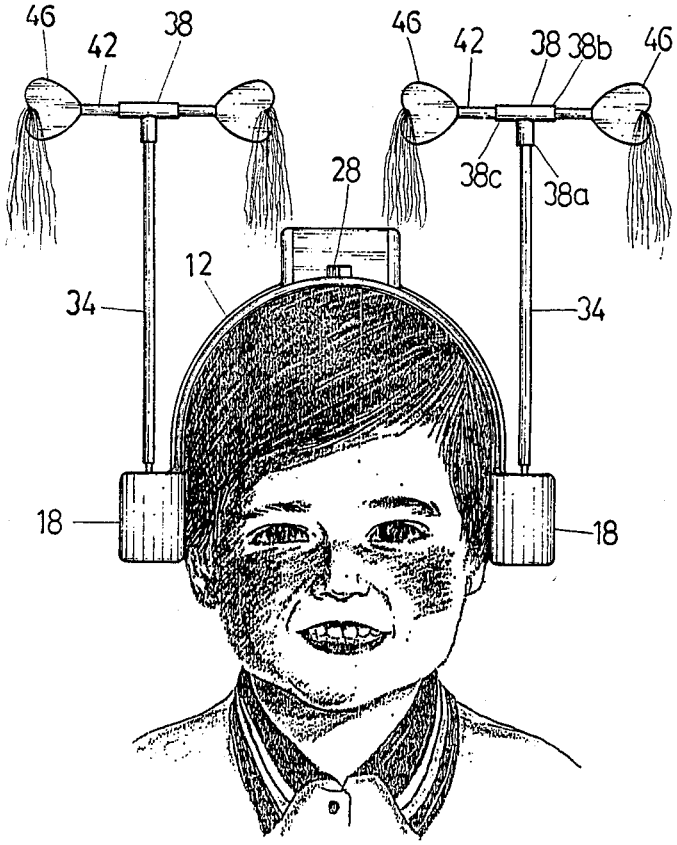
FIG. 3 is a front elevational view of showing a head-mounted double motor-driven toy in place on a children's head.

Referring now more particularly to FIG. 3, on which the motor-driven toy is shown mounted on the head of a child. Whereas the two motors 22 are placed in two motor seats 18 at the free ends of the head mounting band 12, which center of mass is low, so that it can be worn on one person's head firmly and comfortably.

Thus, when the joint 38 is rotated with the rotation shaft 34 as the switch 28 is ON, the ornaments 46 can provide lots of fun and have an attractive appearance.

While the invention has been described in connection with what is presently considered to be the most practical and preferred embodiment, it is not to be limited to the disclosed embodiment but on the contrary, is intended to cover various modification and equivalent arrangements included within the spirit and scope of the appended claims which scope is to be accorded the broadest interpretation so as to encompass all such modification and equivalent structure.

What is claimed is:

1. A head-mounted double motor-driven toy comprising:

a head-mounting band having a central portion and two free end portions extending from said central portion;

a battery case integrally formed on the top of said central portion of said head-mounting band for accommodating batteries and a control switch;

two motor seats equipped with motors, which are secured to said free end portions of the head-mounting band, each motor having a rotation shaft extending through said motor seat perpendicularly to the central portion;

a joint secured to said rotation shaft of each said motor so as to be rotated with said rotation shaft; and a plurality of ornaments secured to each said joint, said motors being connected to said batteries through said control switch for selectively supplying electrical power to said motors to drive the rotation shafts.

* * * * *